United States Patent [19]

Kagoura

[11] 4,099,756

[45] Jul. 11, 1978

[54] LATCH ASSEMBLY

[75] Inventor: Tetsuro Kagoura, Kurobe, Japan

[73] Assignee: Yoshida Kogyo K.K., Tokyo, Japan

[21] Appl. No.: 781,324

[22] Filed: Mar. 25, 1977

[30] Foreign Application Priority Data

Mar. 26, 1976 [JP] Japan ..... 51-33955

[51] Int. Cl.[2] ..... E05C 3/10

[52] U.S. Cl. ..... 292/336.3; 292/207; 292/358

[58] Field of Search ..... 292/207, 208, 347, 358, 292/DIG. 27

[56] References Cited

U.S. PATENT DOCUMENTS

| | | | |
|---|---|---|---|
| 1,387,888 | 8/1921 | Holt | 292/DIG. 27 |
| 2,412,789 | 12/1946 | Voight | 292/359 |
| 3,456,974 | 7/1969 | Moore | 292/359 |

*Primary Examiner*—Richard E. Moore

*Attorney, Agent, or Firm*—Hill, Gross, Simpson, Van Santen, Steadman, Chiara & Simpson

[57] ABSTRACT

A latch assembly comprises a bolt unit mounted in a frame member of a door or window sash, and first and second bolt-driving units installed one on each side of the door or window sash. The bolt unit has a latch bolt supported by a rotatable hollow shaft, the bolt being pivotable between projecting and retracted positions by rotation of the hollow shaft. The first bolt-driving unit includes a first driver torque bar having one end spring-biased for insertion into the hollow shaft for driving engagement therewith. The first driver torque bar can be turned about its longitudinal axis by a handle. The second bolt-driving unit includes a second driver torque bar having one end spring-biased for withdrawal out of driving engagement with the hollow shaft. The second driver torque bar can be turned about its longitudinal axis by a knob. The handle is pivoted to actuate the latch bolt for normal latching and unlatching operation. When it is necessary to lock or unlock the door or sash from the other side thereof such as in case of emergency, then the knob is pushed to cause the second torque bar to enter the hollow shaft and displace the first torque bar out of the hollow shaft via a pin which is axially slidably disposed in the hollow shaft. The knob can be turned to actuate the latch bolt independently of the first bolt-driving unit.

16 Claims, 4 Drawing Figures

LATCH ASSEMBLY

BACKGROUND OF THE INVENTION

1. Field of the Invention

The present invention relates to a latch assembly for use on a frame member of a window sash or door.

2. SUMMARY OF THE INVENTION

The latch assembly of the invention includes a bolt unit having a pivotable latch bolt supported by a hollow shaft mounted rotatably in a support frame to be installed in a window sash or door frame member, and a first bolt-driving unit having a casing to be attached to the frame member, a handle having a shaft disposed rotatably in the casing, and a first driver torque bar having one end mounted coaxially in the handle shaft for corotation therewith and the opposite end inserted coaxially in one end of the hollow shaft in driving engagement therewith. When the handle is manipulated to pivot about its shaft, the driver torque bar rotates the hollow shaft about its longitudinal axis, and hence the latch bolt about the axis of the hollow shaft into or out of a projecting position. A second bolt-driving unit includes a hollow housing attachable to the frame member and having a sleeve, a second driver torque bar extending through the sleeve and supported by the hollow housing for rotation and axial movement therein, and a knob to which one end of the second driver torque bar is fixed, the opposite end thereof being insertable into the other end of the hollow shaft for driving engagement therewith upon movement of the knob toward the housing. With the second driver torque bar pushed in and engaging the hollow shaft, the knob is turned to swing the latch bolt. Between the opposite ends of the first and second torque bars, there is interposed a pin in endwise engagement therewith for pushing the opposite end of the first torque bar out of engagement with the hollow shaft when the knob is urged fully toward the hollow housing.

Accordingly, it is an object of the present invention to provide a latch assembly having a compact mechanism.

Another object of the present invention is to provide a latch assembly comprising unitized component parts.

Another object of the present invention is to provide a latch assembly which can easily be assembled and installed.

A still further object of the present invention is to provide a latch assembly which can be operated with minimum force from either the inside or outside of a panel member on which the latch assembly is mounted.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
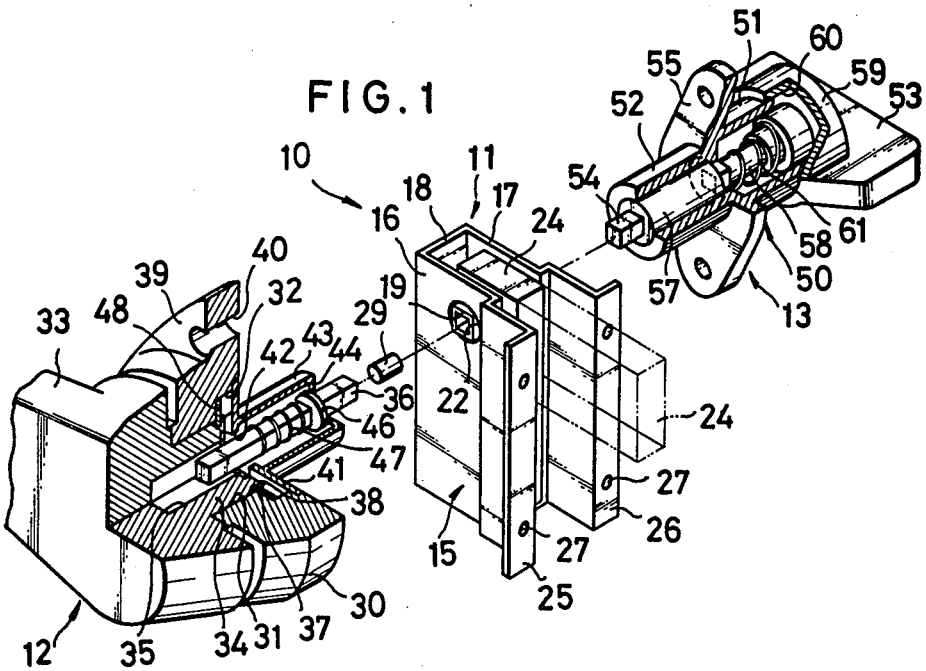
FIG. 1 is an exploded perspective view, with parts broken away, of a latch assembly constructed in accordance with the present invention.

The principles of the present invention are particularly useful when embodied in a latch assembly such as shown in FIG. 1, generally indicated by the numeral 10. The latch assembly 10 broadly comprises a latch bolt unit 11, a first bolt-driving unit 12, and a second bolt-driving unit 13, these units when assembled together being installed, for example, on a vertical frame member or stile 14 (FIG. 2) of a swinging window sash or door.

As shown in FIG. 1, the latch bolt unit 11 comprises a support frame 15 of a generally channel-shaped cross-section having a pair of spaced walls 16,17 and an end wall 18 interconnecting the spaced walls 16,17, a hollow shaft 19 of a square cross-section extending across and through the spaced walls 16,17 and having both ends 20,21 (FIG. 2) supported rotatably in a pair of circular holes 22,23 in the spaced walls 16,17, respectively, and a latch bolt 24 fixed at one end to the hollow shaft 19 and extending radially from the hollow shaft 19 substantially perpendicularly to its axis. The latch bolt 24 is pivotable or angularly movable substantially 90° between a first or withdrawn vertical position shown in solid lines in which the bolt 24 is retracted within the support frame 15, and a second or horizontally projecting position shown in broken lines in which the bolt 24 projects outwardly from the support frame 15. The spaced walls 16,17 have a pair of attachment flanges 25,26, respectively, located remotely from the end wall 18, the flanges 25,26 having screw holes 27.

A leaf spring 28 is mounted on the end wall 18 and acts on the latch bolt 24 for maintaining it in the first position against rattling movement or in the second position against gravity. A pin 29 is disposed axially slidably in the hollow shaft 19 and has a length which allows the first and second bolt-driving units 12,13 to be manipulated independently of each other as is described below.

The first bolt-driving unit 12 comprises a substantially circular casing 30 having a central bore 31 and a counterbore 32, a handle 33 having on one end a cylindrical shaft 34 rotatably disposed in the bore 31 and a central slot 35 of a square cross-section located coaxially in the shaft 34, and a first driver torque bar or spindle 36 of a square cross-section having one end axially slidably corotatably received in the slot 35. The shaft 34 has on its free end an annular plate 48 which is held slidably against the bottom of the counterbore 32. Thus, the shaft 34 is axially immovable or retained against removal from the casing 30. For attachment of the annular plate 48, the shaft 34 has an annular groove 37 and an annular lip 38 which is initially parallel with the axis of the shaft 34. After the parts are assembled as shown the annular lip 38 is deformed or staked so as to hold the annular plate 48 in place. The casing 30 has an upper attachment flange 39 with a screw hole 40 and a similar lower attachment flange (not shown).

Another annular plate 41 attached at the end of counterbore 32, has a central opening 42 coaxial with the slot 35. The annular plate 41 supports a projecting coaxial sleeve 43 away from and extending coaxially with the central bore 31, the sleeve 43 having on its free end a wall 44 with having an end central aperture 45. The driver torque bar 36 extends through the opening 42 and the aperture 45, and has a free end projecting beyond the end wall 44 of the sleeve 43. A retainer flange 46 is fixed to the torque bar 36 and confined within the sleeve 43 to capture the torque bar 36 in the unit 12. A compression coil spring 47 is disposed around the torque bar 36, the spring 47 acting between the annular plate 41 and the retainer flange 46 to normally bias the torque bar 36 away from the handle shaft 34. And the retainer flange 46 against the end wall 44.

The second bolt-driving unit 13 comprises a hollow housing 50 including a first sleeve 51 and a second sleeve 52 coaxial with the first sleeve 50, a knob 53, and a second driver torque bar 54 extending through the sleeves 51,52. Between the first and second sleeves 51,52, an attachment flange 55 has a central hole 56 through which the torque bar 54 extends. The torque bar 54 has an end portion of a square cross-section and a cylindrical portion 57 in the second sleeve 52 for rotation and axial sliding movement therein. The driver torque bars 36,54 slidably fit in the hollow shaft 19 for driving engagement therewith. The torque bar 54 includes a coaxial spindle portion 58 extending through the first sleeve 51 and corotatably fixed to the knob 53. The knob 53 has a hollow cylinder 59 bounding an annular groove 60 which slidably and guidingly receives the first sleeve 51. A compression coil spring 61 around the spindle 58 acts between the flange 55 and the knob 53 to normally bias the knob 53 away from the housing 50. With the spring 61 expanded, the cylindrical portion 57 is urged against the flange 55 at the hole 56, and the free end of the driver torque bar 54 projects beyond the end of the second sleeve 52.

Figure 2:
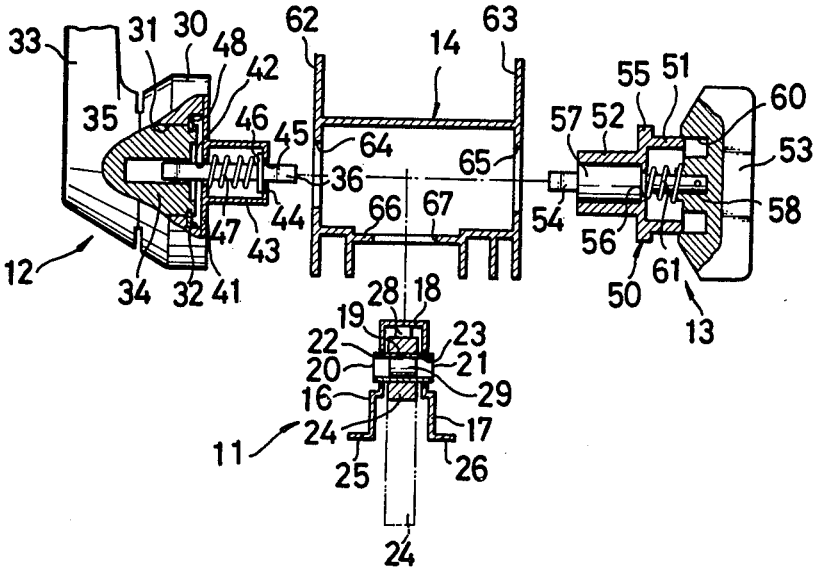
FIG. 2 is an exploded top view, with parts broken away and on a reduced scale, of the latch assembly just before installation on a frame member.

As best shown in FIG. 2, the stile 14 includes a pair of spaced plates 62,63 having a pair of attachment openings 64,65, respectively, and a side plate 66 interconnecting the spaced plates 62,63 and having an attachment opening 67. When the window sash or door is closed, the side plate 66 faces a side jamb (not shown) that is part of a frame in which the window sash or door is mounted. The side jamb has a recess into which the latch bolt 24 can project for locking the window sash or door.

For assembling the latch assembly 10, the bolt unit 11 is first inserted into the opening 67 in the side plate 66 and the attachment flanges 25,26 are secured to the side plate 66 by means of screws (not shown) extending through the screw holes 27. Then, the first and second bolt-driving units 12,13 are installed on the stile 14, with the sleeve 43 inserted in the opening 64 and the sleeve 52 in the opening 65. The units 12,13 are fixed to the stile 14 by means of screws (not shown).

Figure 3:
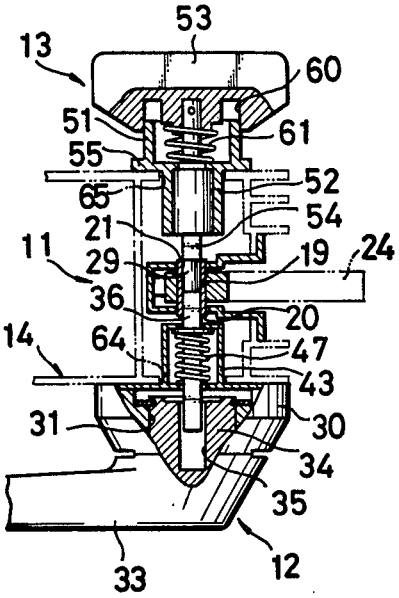
FIG. 3 is a top plan view, partly cut away, of the latch assembly when it is assembled and ready for actuation by a first bolt-driving unit.
Figure 4:
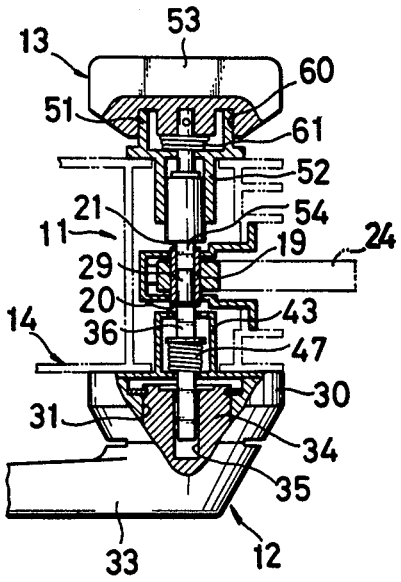
FIG. 4 is a view similar to FIG. 3 but showing the latch assembly when it can be actuated by a second bolt-driving unit.

As shown in FIGS. 3 and 4, the driver torque bars 36,54 are aligned with each other and with the hollow shaft 19. The free end of the first driver torque bar 36 is in the hollow shaft 19 and the free end of the second driver torque bar 54 is substantially flush with the end 21 of the hollow shaft 19, the pin 29 being therebetween in endwise engagement therewith. With the parts urged to the position of FIG. 3, the pin 29 has one end lying substantially flush with the end 21 of the hollow shaft 19. When the knob 53 is pushed toward the housing 50 the free end of the torque bar 54 enters the hollow shaft 19 and displaces the pin 29 axially, and upon full insertion of the torque bar 54, the pin 29 has its other end lying substantially flush with the end 20 of the hollow shaft 19. At this time, the pin 29 displaces the distal end of the driver torque bar 36 out of the hollow shaft 19, as shown in FIG. 4.

Usually, the first bolt-driving unit 12 is mounted on the inner side of the door or sash, and the second bolt-driving unit 13 on the outer side thereof. For normal latching or unlatching operation, the handle 33 is pivoted for 90° angular movement to actuate the latch bolt 24 independently of the second bolt-driving unit 13. When it is required to lock or unlock the window sash or door from the outside thereof, the knob 53 is pushed and the pin 29 forces the end of the first driver torque bar 36 out of the hollow shaft 19 enabling the knob 53 to be turned 90° to operate the latch bolt 24 independently of the first bolt-driving unit 12.

Unitized for compactness, the first and second bolt-driving units 12,13, and the bolt unit 11 can be installed separately with maximum ease, and no special machining other than drilling is needed on the frame member 14. Furthermore, a choice is available of various combinations between the bolt unit 11, and the first and second bolt-driving units 12,13 for a wide range of applications. The second bolt-driving unit 13 can be used as an emergency control for windows to which the public has no access from the outside, such as those of a multistory building.

Although various minor modifications may be suggested by those versed in the art, it should be understood that I wish to embody within the scope of the patent warranted hereon, all such embodiments as reasonably and properly come within the scope of my contribution to the art.

What I claim is:

1. A latch assembly for use on a closure frame member, comprising:

(a) a support frame having means for being attached to the closure frame member;

(b) a hollow shaft mounted in said support frame for rotation about a longitudinal axis thereof;

(c) a latch bolt fixed at one end thereof to said hollow shaft and extending radially from said hollow shaft, said latch bolt being angularly movable about said axis between a first position in which said bolt is retracted within said support frame and a second position in which said bolt has the opposite end projecting outwardly from said support frame;

(d) a casing having means for being attached to the closure frame member, said casing having a bore;

(e) a handle having a shaft rotatably disposed in said bore; and (f) a driver torque bar having one end mounted coaxially in said handle shaft for corotation therewith, said driver torque bar having the opposite end extending into said hollow shaft in driving engagement therewith.

2. A latch assembly according to claim 1, said hollow shaft and driver torque bar being of square cross-section.

3. A latch assembly according to claim 1, said support frame including a pair of spaced walls and an end wall interconnecting said spaced walls, and said hollow shaft extending across and through said spaced walls.

4. A latch assembly according to claim 3, including a spring acting between said end wall and said latch bolt for maintaining said latch bolt in one of said first and second positions.

5. A latch assembly according to claim 1, said driver torque bar being slidable along said axis, and a spring normally urging said driver torque bar into engagement with said hollow shaft.

6. A latch assembly for use on a closure frame member, comprising:

(a) a support frame having means for being attached to the closure frame member;

(b) a hollow shaft mounted in said support frame for rotation about a longitudinal axis thereof;

(c) a latch bolt fixed at one end thereof to said hollow shaft and extending radially from said hollow shaft, said latch bolt being angularly movable about said axis between a first position in which said bolt is retracted within said support frame and a second position in which said bolt has the opposite end projecting outwardly from said support frame;

(d) a hollow housing having means for being attached to the closure frame member, said housing including a sleeve;

(e) a knob having an annular groove which receives said sleeve slidably therein for guiding the movement of said knob toward and away from said housing; and (f) a driver torque bar extending through said sleeve and supported rotatably and axially slidably in said housing, said driver torque bar having one end secured to said knob for corotation therewith and the opposite end being insertable coaxially in said hollow shaft for driving engagement therewith.

7. A latch assembly according to claim 6, said hollow shaft and driver torque bar being of square cross-section.

8. A latch assembly according to claim 6, said support frame including a pair of spaced walls and an end wall interconnecting said spaced walls, and said hollow shaft extending across and through said spaced walls.

9. A latch assembly according to claim 8, including a spring acting between said end wall and said latch bolt for maintaining said latch bolt in one of said first and second positions.

10. A latch assembly according to claim 6, including a spring normally urging said driver torque bar out of engagement with said hollow shaft.

11. A latch assembly for use on a closure frame member, comprising:

(a) a bolt unit including:

(1) a support frame having means for being attached to the closure frame member;

(2) a hollow shaft mounted in said support frame for rotation about a longitudinal axis thereof; and (3) a latch bolt fixed at one end thereof to said hollow shaft and extending radially from said hollow shaft, said latch bolt being angularly movable about said axis between a first position in which said bolt is retracted within said support frame and a second position in which said bolt has the opposite end projecting outwardly from said support frame;

(b) a first bolt-driving unit including:

(1) a casing having means for being attached to the closure frame member, said casing having a bore;

(2) a handle having a shaft rotatably disposed in said bore; and (3) a first driver torque bar having one end mounted coaxially in said handle-shaft for corotation therewith and axial movement therein, said first driver torque bar having the opposite end extending coaxially into one end of said hollow shaft in driving engagement therewith and retractable therefrom; and (c) a second bolt-driving unit including:

(1) a hollow housing having means for being attached to the closure frame member, said housing including a sleeve;

(2) a knob having an annular groove which receives said sleeve slidably therein for guiding the movement of said knob toward and away from said housing; and (3) a second driver torque bar extending through said sleeve and supported rotatably and axially slidably in said housing, said second driver torque bar having one end secured to said knob for corotation therewith and its opposite end being insertable coaxially in the other end of said hollow shaft for driving engagement therewith and for effecting displacement of said first driver torque bar out of said hollow shaft.

12. A latch assembly according to claim 11, said hollow shaft and driver torque bar being of square cross-section.

13. A latch assembly according to claim 11, said support frame including a pair of spaced walls and an end wall interconnecting said spaced walls, and said hollow shaft extending across and through said spaced walls.

14. A latch assembly according to claim 13, including a spring acting between said end wall and said latch bolt for maintaining said latch bolt in one of said first and second positions.

15. A latch assembly according to claim 11, including a first spring normally urging said first driver torque bar into engagement with said hollow shaft, and a second spring normally urging said second driver torque bar out of engagement with said hollow shaft.

16. A latch assembly according to claim 11 including a pin disposed axially slidably in said hollow shaft in endwise engagement with said opposite ends of said driver torque bars, said pin being capable of effecting the displacement of said opposite end of said first driver torque bar out of engagement with said hollow shaft in response to insertion of said opposite end of said second driver torque bar into said hollow shaft upon movement of said knob toward said housing.

* * * * *